US010746456B2

(12) United States Patent
Kim et al.

(10) Patent No.: US 10,746,456 B2
(45) Date of Patent: Aug. 18, 2020

(54) INDOOR UNIT OF AIR CONDITIONER AND BLADE UNIT APPLIED TO SAME

(71) Applicant: Samsung Electronics Co., Ltd, Gyeonggi-do (KR)

(72) Inventors: Mun Sub Kim, Gyeonggi-do (KR); Hyun Wuk Kang, Gyeonggi-do (KR); You Jae Kim, Gyeonggi-do (KR); Jin Yong Mo, Gyeonggi-do (KR); Hyeong Joon Seo, Gyeonggi-do (KR); Woong Sun, Incheon (KR); Jun Riul Song, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 835 days.

(21) Appl. No.: 15/122,407

(22) PCT Filed: Feb. 25, 2015

(86) PCT No.: PCT/KR2015/001808

§ 371 (c)(1),
(2) Date: Aug. 29, 2016

(87) PCT Pub. No.: WO2015/130073

PCT Pub. Date: Sep. 3, 2015

(65) Prior Publication Data

US 2017/0067681 A1 Mar. 9, 2017

(30) Foreign Application Priority Data

Feb. 28, 2014 (KR) ..... 10-2014-0024564
Nov. 10, 2014 (KR) ..... 10-2014-0155572

(51) Int. Cl.
*F24F 1/0047* (2019.01)
*F25D 17/06* (2006.01)
(Continued)

(52) U.S. Cl.
CPC ..... *F25D 17/067* (2013.01); *F24F 1/0011* (2013.01); *F24F 1/0047* (2019.02);
(Continued)

(58) Field of Classification Search
CPC ..... F25D 17/067; F24F 1/0047; F24F 1/0011; F24F 13/14; F24F 13/24; F24F 2013/146
See application file for complete search history.

(56) References Cited

U.S. PATENT DOCUMENTS 2,117,529 A * 5/1938 Wile ..... F24F 13/15 236/1 C
2,698,570 A * 1/1955 Feinberg ..... F24F 11/76 454/258

(Continued)

FOREIGN PATENT DOCUMENTS

CN 1230667 A 10/1999
CN 2567496 Y 8/2003

(Continued)

OTHER PUBLICATIONS

Engineering Tool Box, (2003). Young's Modulus—Tensile and Yield Strength for common Materials. [online] Available at: https://www.engineeringtoolbox.com/young-modulus-d_417.html [Accessed Apr. 25, 2019]. (Year: 2003).*

(Continued)

*Primary Examiner* — Moshe Wilensky
*Assistant Examiner* — Theodore C Ribadeneyra

(57) ABSTRACT

Disclosed are provided indoor unit of an air conditioner. A present invention is to provide an indoor unit of an air conditioner having an improved structure for preventing vibrations and noise of a blade due to vibrations of a motor when the blade rotates, and a blade unit applied to the indoor unit. The indoor unit of the air conditioner includes a main body including an outlet, and a blade unit configured to (Continued)

adjust a direction in which air discharged from the outlet is discharged, wherein the blade unit comprises, a blade coupled with the main body to be rotatable in the outlet, a motor including a rotation transfer member, and configured to generate a rotatory force that is transferred to the blade; and a buffer member made of a material having a restoring force, coupled with the blade at one end, and surrounding a part of the rotation transfer member.

20 Claims, 9 Drawing Sheets

(51) Int. Cl.
*F24F 1/0011* (2019.01)
*F24F 13/24* (2006.01)
*F24F 13/14* (2006.01)

(52) U.S. Cl.
CPC ..... *F24F 13/14* (2013.01); *F24F 13/24* (2013.01); *F24F 2013/146* (2013.01)

(56) References Cited

U.S. PATENT DOCUMENTS

| | | | | | |
|---|---|---|---|---|---|
| 3,063,357 | A * | 11/1962 | Eberhart | F24F 13/075 | 454/320 |
| 4,541,326 | A | 9/1985 | Fukuda et al. | | |
| 4,782,999 | A * | 11/1988 | Ishii | F24F 1/0011 | 236/49.3 |
| 5,022,583 | A * | 6/1991 | Bruens | G05D 23/023 | 236/100 |
| 5,388,426 | A * | 2/1995 | Wada | F24F 1/0007 | 62/263 |
| 5,878,591 | A * | 3/1999 | Tsuji | F24F 1/0011 | 62/285 |
| 5,888,133 | A * | 3/1999 | Mori | F24F 1/0011 | 454/318 |
| 6,196,018 | B1 * | 3/2001 | Mori | F24F 1/0007 | 62/404 |
| 6,557,364 | B2 * | 5/2003 | Gunji | F24F 1/0007 | 62/263 |
| 7,656,664 | B2 * | 2/2010 | Ye | H05K 7/20154 | 361/691 |
| 7,827,810 | B2 * | 11/2010 | Hur | F24F 1/0007 | 62/126 |
| 8,074,462 | B2 * | 12/2011 | Yasutomi | F24F 1/0007 | 62/263 |
| 8,252,078 | B2 * | 8/2012 | Mun | F24F 1/0007 | 55/283 |
| 8,505,327 | B2 * | 8/2013 | Son | F24F 1/0007 | 62/407 |
| 2003/0180165 | A1 * | 9/2003 | Motomura | F04D 29/263 | 417/423.12 |
| 2005/0279118 | A1 * | 12/2005 | Son | F24F 1/0057 | 62/408 |
| 2013/0167579 | A1 * | 7/2013 | Delgadillo | F25D 13/00 | 62/426 |
| 2015/0252816 | A1 * | 9/2015 | Nakai | F04D 29/283 | 416/178 |

FOREIGN PATENT DOCUMENTS

| | | | |
|---|---|---|---|
| CN | 201246854 | Y | 5/2009 |
| CN | 101762005 | A | 6/2010 |
| CN | 103375841 | A | 10/2013 |
| DE | 3423928 | A1 | 1/1985 |
| EP | 0886111 | A2 | 12/1998 |
| EP | 1380797 | A1 | 1/2004 |
| JP | H 07-293992 | | 11/1995 |
| JP | H 11-14134 | | 1/1999 |
| KR | 10-2008-0078188 | | 8/2008 |
| KR | 10-2012-0075996 | | 7/2012 |
| KR | 10-1271060 | | 6/2013 |
| WO | 2013054537 | A1 | 4/2013 |

OTHER PUBLICATIONS

Supplementary European Search Report dated Jan. 3, 2018 in connection with European Patent Application No. 15 75 4617, 9 pages.

Office Action dated Nov. 5, 2018 in connection with Chinese Patent Application No. 201580011189.7, 30 pages.

International Search Report dated May 28, 2015 in connection with International Application No. PCT/KR2015/001808, 3 pages.

Written Option of the International Searching Authority dated May 28, 2015 in connection with International Application No. PCT/KR2015/001808, 10 pages.

Communication from a foreign patent office in a foreign counterpart application, European Patent Office, "Supplementary European Search Report," Application No. EP 15 75 4617.7, dated Jan. 3, 2018, 9 pages.

Communication from a foreign patent office in a foreign counterpart application, European Patent Office, "Communication pursuant to Rules 161(2) and 162 EPC," Application No. EP 15 75 4617.7, dated Jan. 20, 2017, 2 pages.

Chinese National Intellectual Property Administration, The Second Office Action, dated Jun. 20, 2019, regarding Application No. 201580011189.7, 39 pages.

Communication pursuant to Article 94(3) EPC in connection with European Application No. 15754617.7 dated May 26, 2020, 6 pages.

* cited by examiner

[Fig. 1]
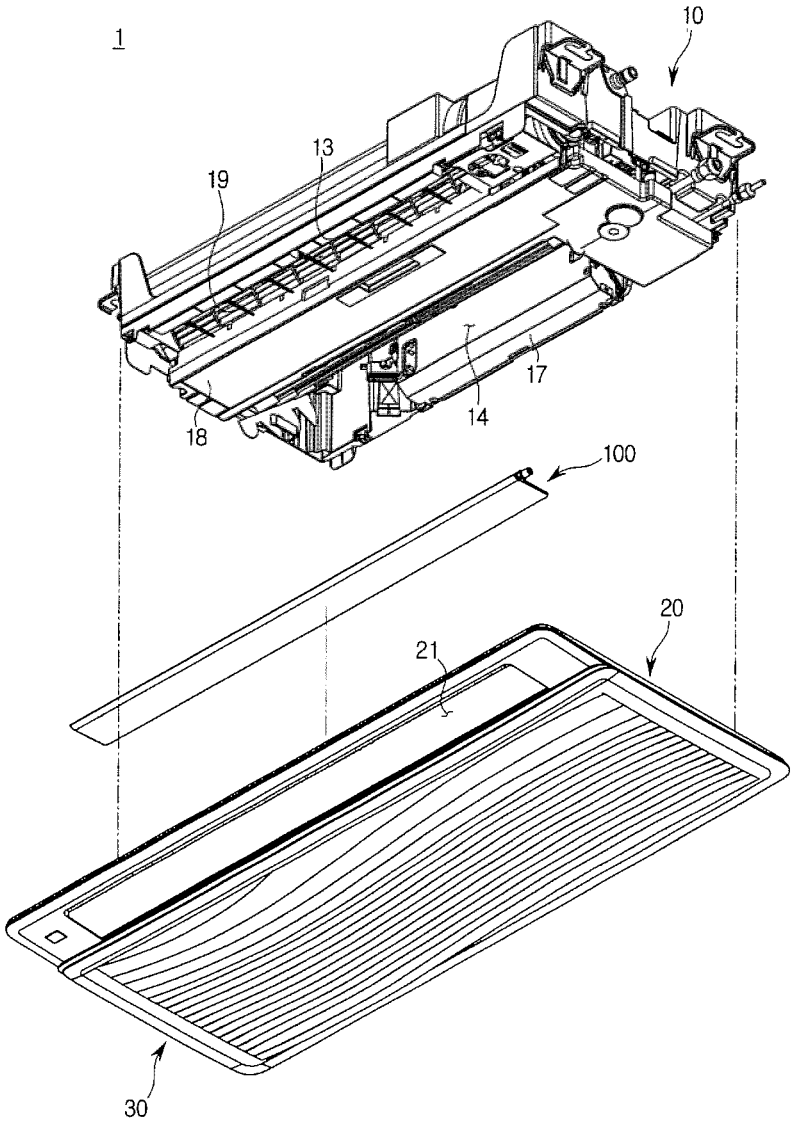

[Fig. 2]
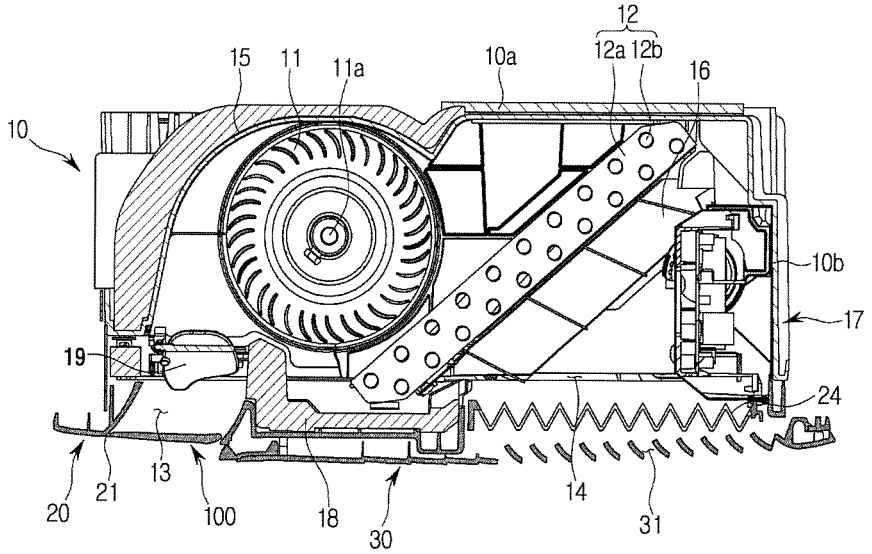
[Fig. 3]
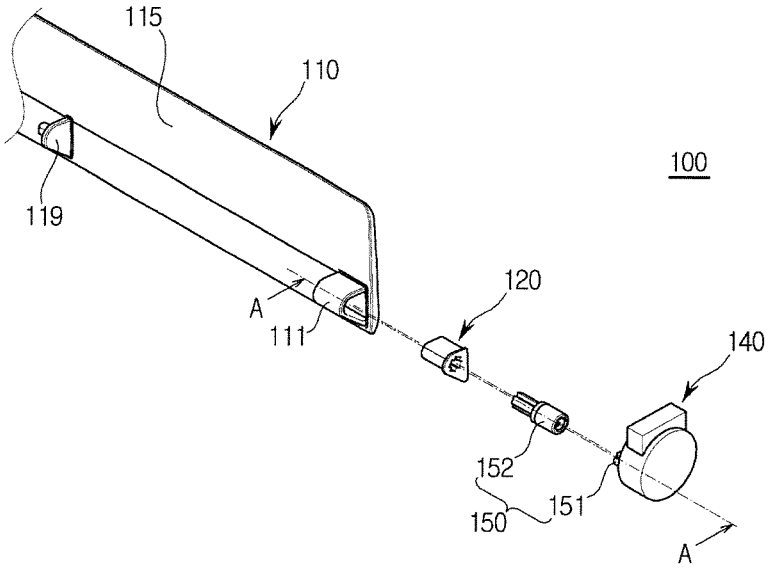

[Fig. 4]
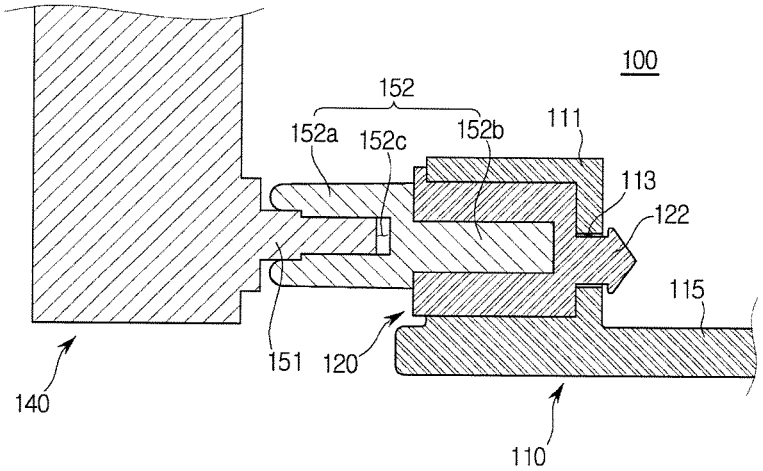
[Fig. 5]
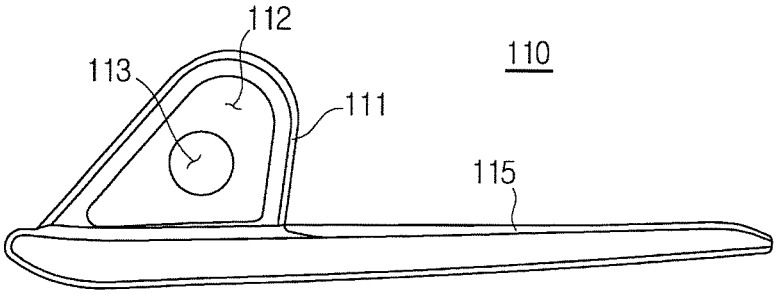
[Fig. 6]
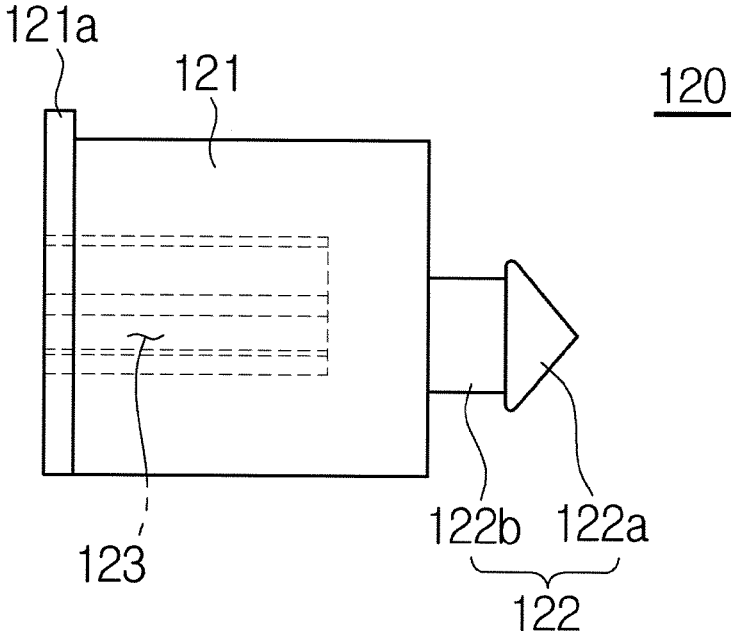

[Fig. 7]
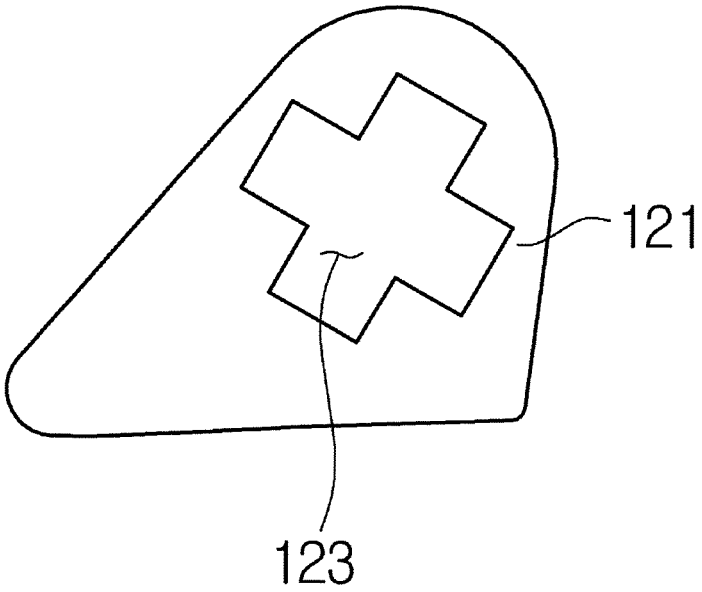
[Fig. 8]
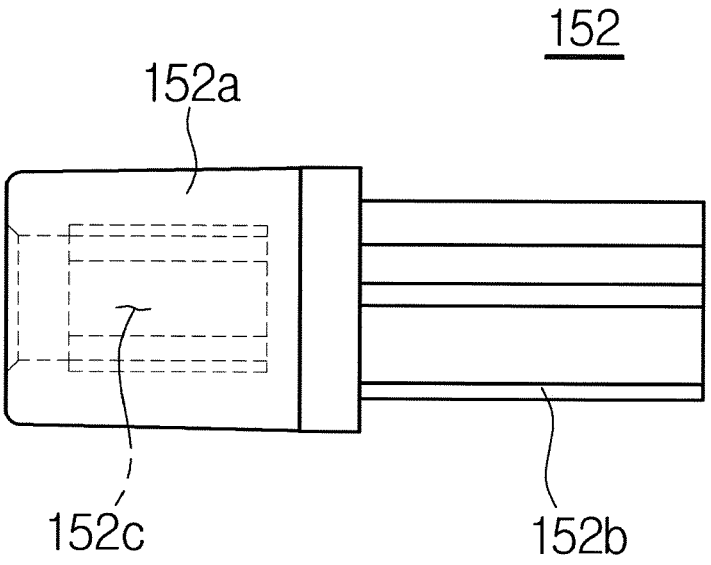

[Fig. 9]
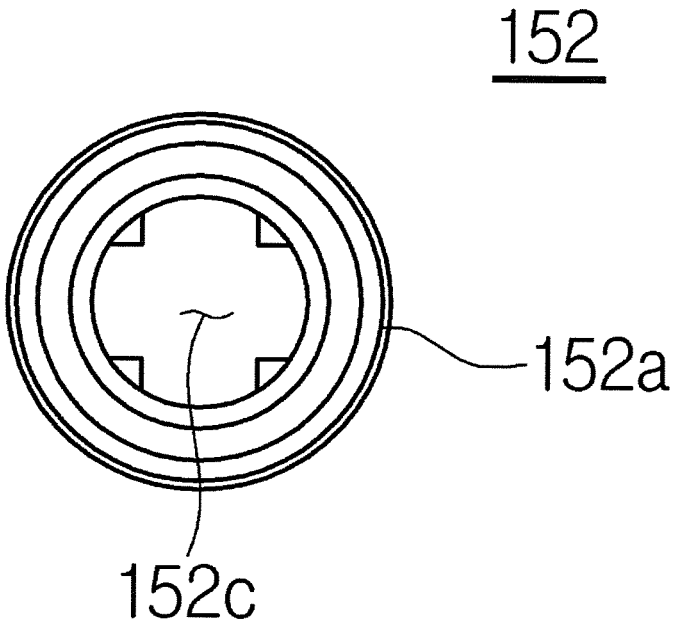
[Fig. 10]
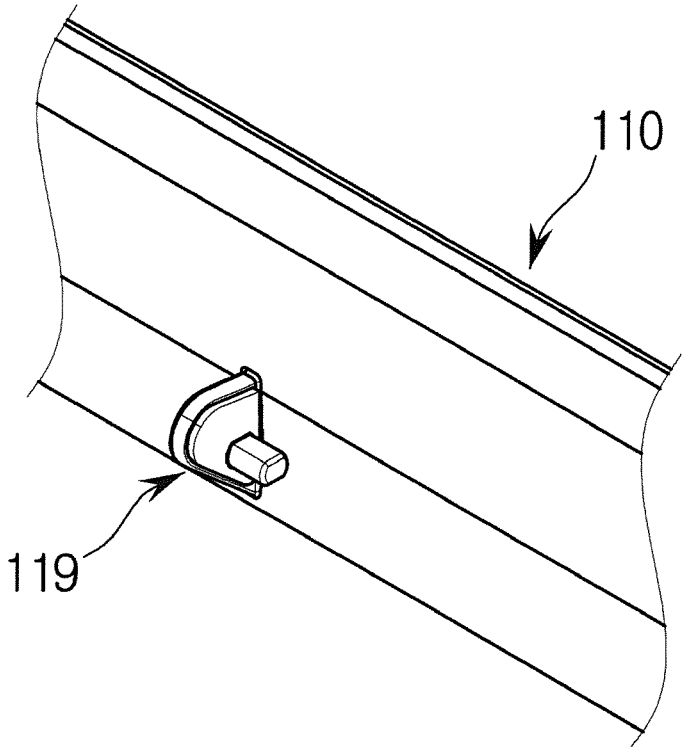

[Fig. 11]
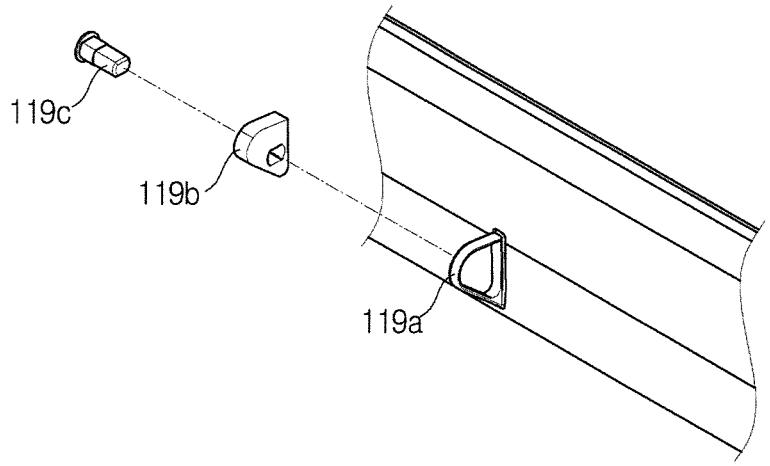
[Fig. 12]
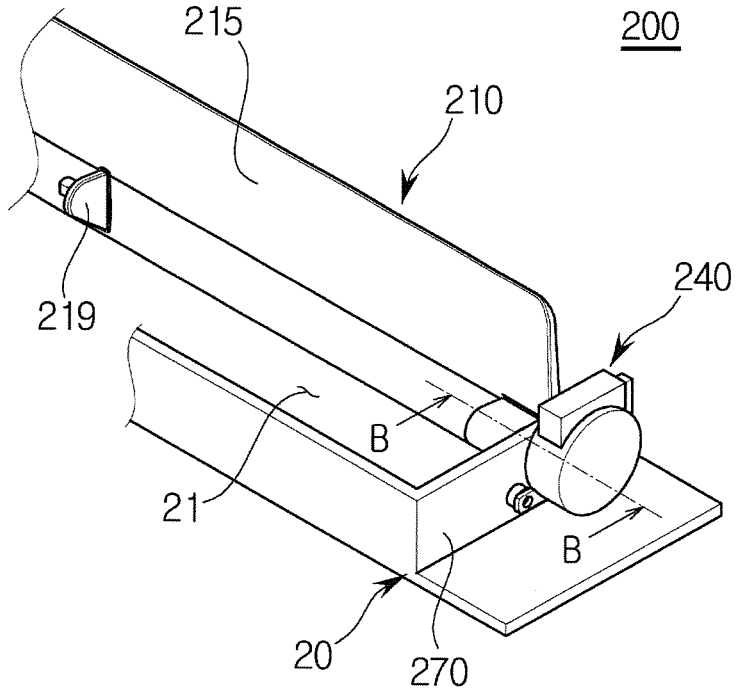

[Fig. 13]
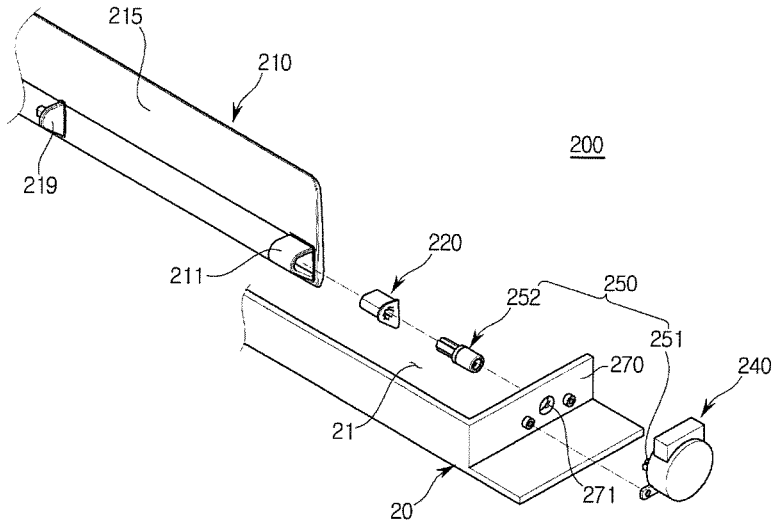
[Fig. 14]
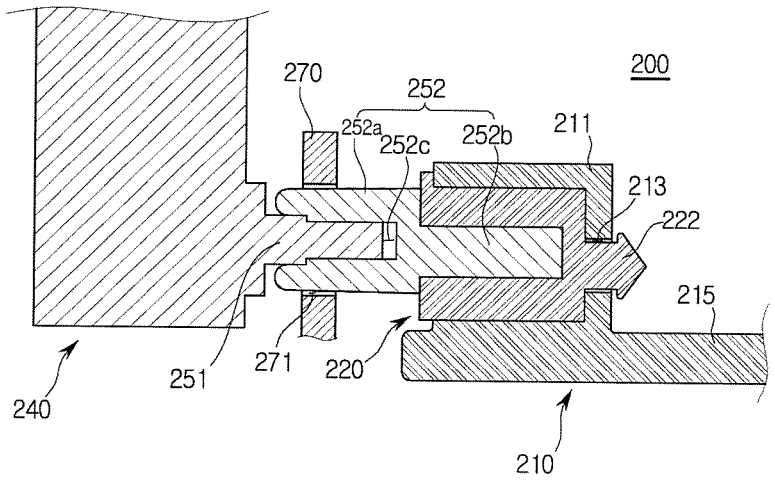

[Fig. 15]
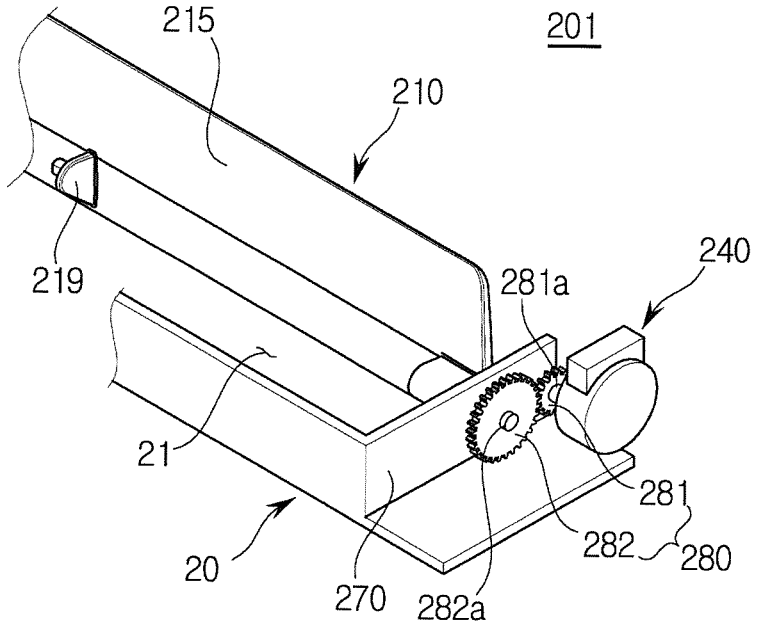
[Fig. 16]
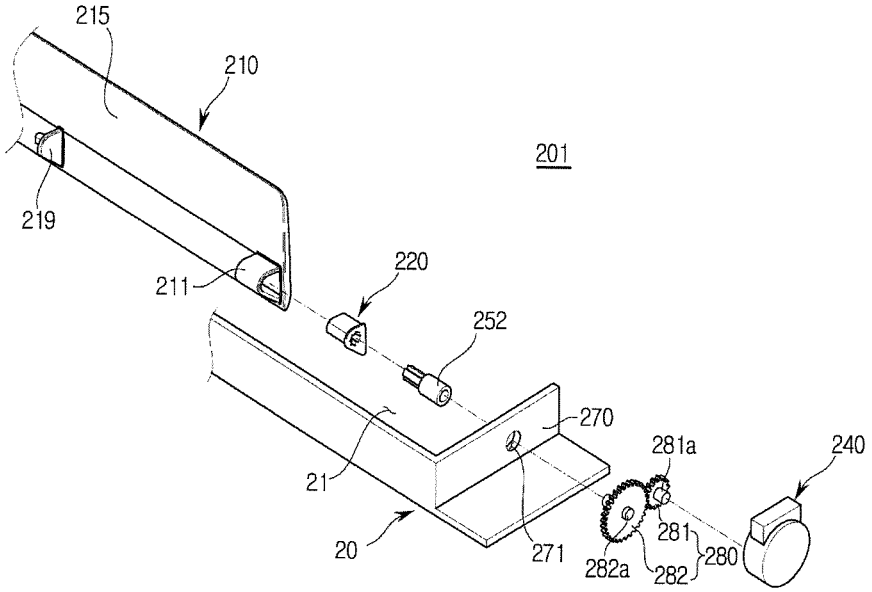

[Fig. 17]
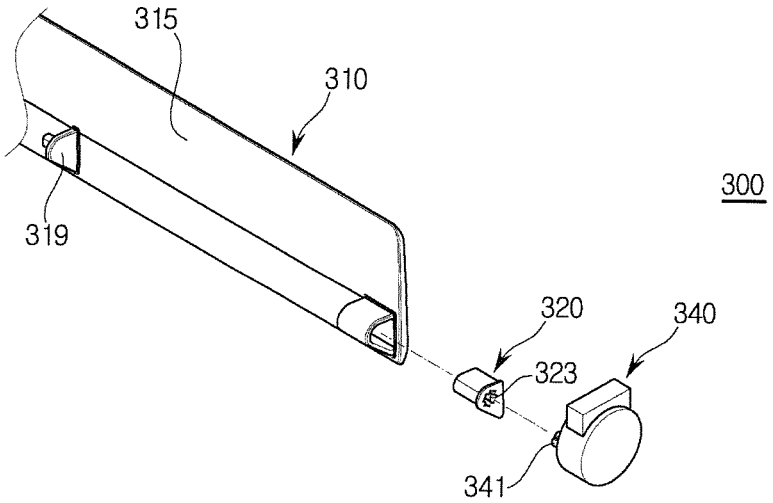

INDOOR UNIT OF AIR CONDITIONER AND BLADE UNIT APPLIED TO SAME

CROSS-REFERENCE TO RELATED APPLICATIONS AND CLAIM OF PRIORITY

The present application claims priority under 35 U.S.C. § 365 to International Patent Application No. PCT/KR2015/001808 filed Feb. 25, 2015, entitled "INDOOR UNIT OF AIR CONDITIONER AND BLADE UNIT APPLIED TO SAME", and, through International Patent Application No. PCT/KR2015/001808, to Korean Patent Application No. 10-2014-0024564 filed Feb. 28, 2014, and Korean Patent Application No. 10-2014-0155572 filed Nov. 10, 2014, each of which are incorporated herein by reference into the present disclosure as if fully set forth herein.

TECHNICAL FIELD

The present invention relates to an indoor unit of an air conditioner, and a blade unit applied to the indoor unit, and more particularly, to an indoor unit of an air conditioner having an improved structure for preventing vibrations and noise due to rotation of a blade, and a blade unit applied to the indoor unit.

BACKGROUND ART

In general, an air conditioner is an electronic appliance for maintaining indoor air at pleasant temperature using a cooling cycle of refrigerants. The air conditioner includes an indoor unit, an outdoor unit, and a refrigerant pipe, wherein the indoor unit includes a heat exchanger, a blower fan, etc. and is installed indoor, the outdoor unit includes a heat exchanger, a blower fan, a compressor, a condenser, etc. and is installed outdoor, and the refrigerant pipe connects the indoor unit to the outdoor unit and circulates refrigerants.

The air conditioner can be classified into a stand type air conditioner in which an indoor unit is installed on the floor, a wall-mounted air conditioner in which an indoor unit is mounted on a wall, and a ceiling type air conditioner in which an indoor unit is mounted on a ceiling, according to places where the indoor unit is installed. In the ceiling type air conditioner, the indoor unit is embedded into or hung on the ceiling.

Since the indoor unit of the ceiling type air conditioner is mounted on the ceiling, an inlet for inhaling indoor air, and an outlet for discharging air heat-exchanged through the heat exchanger to the indoor space are disposed in the lower part of the main body. The indoor unit of the ceiling type air conditioner can be classified into a 1-way type with a single outlet and a 4-way type with four outlets forming a quadrangle, according to the number of outlets.

Generally, the indoor unit of the air conditioner includes a blade for adjusting a direction in which heat-exchanged air is discharged, in the outlet. The blade is rotatably coupled with one part of the outlet. The blade is coupled with a motor at one end, and receives a rotatory force generated by the motor to rotate.

The blade is configured to be rotatable in both directions. The blade rotates in both directions in the outlet to adjust the movement direction of heat-exchanged air in the up-down direction. However, since the blade is directly connected to the motor, vibrations and noise may be generated when the motor transfers a rotatory force to the blade. Also, when the indoor unit of the ceiling type air conditioner is installed non-horizontally to the ceiling, a connection axis along which the blade is coupled with the motor is misaligned so that vibration sound of the motor and friction sound of the blade may be loudly generated.

DISCLOSURE

Technical Problem

An aspect of the present invention is to provide an indoor unit of an air conditioner having an improved structure for preventing vibrations and noise of a blade due to vibrations of a motor when the blade rotates, and a blade unit applied to the indoor unit.

Another aspect of the present invention is to provide an indoor unit of a ceiling type air conditioner having an improved structure for enabling a blade to easily rotate in an outlet even when the indoor unit is installed non-horizontally to a ceiling, and a blade unit applied to the indoor unit.

Technical Solution

In accordance with an aspect of the present disclosure, an indoor unit of an air conditioner includes a main body including an outlet, and a blade unit configured to adjust a direction in which air discharged from the outlet is discharged, wherein the blade unit comprises, a blade coupled with the main body to be rotatable in the outlet, a motor including a rotation transfer member, and configured to generate a rotatory force that is transferred to the blade, and a buffer member made of a material having a restoring force, coupled with the blade at one end, and surrounding a part of the rotation transfer member.

The buffer member may be inserted into one end of the blade while surrounding the part of the rotation transfer member.

The blade may include a coupling member in which a coupling groove is formed, at one edge, and the buffer member has a shape corresponding to the coupling groove to be inserted into the coupling groove.

The buffer member may include a buffer groove into which the rotation transfer member is inserted.

The coupling member may include a first coupling member connected to the rotation transfer member, and a second coupling member disposed at the blade to face the first coupling member, and connected to the main body such that the blade is rotatable.

The coupling member may further include a third coupling member positioned between the first coupling member and the second coupling member, and the third coupling member may couple the blade with the main body such that the blade is rotatable.

The third coupling member may include a protrusion coupled with a part of the main body, and a buffer part made of a material having a restoring force, and surrounding the protrusion.

The rotation transfer member may include a rotation shaft extending from the motor, and configured to transfer a rotatory force generated by the motor, and a connection member coupled with the rotation shaft at one end, and coupled with the buffer member at the other end.

The connection member may include a connection body part coupled with the rotation shaft, and a connection protrusion extending from the connection body part, and coupled with the buffer member.

The connection member may be made of a material having stiffness that is lower than stiffness of the rotation shaft.

In accordance with another aspect of the present disclosure, a blade unit configured to adjust a direction of air heat-exchanged and then discharged from an outlet provided in an indoor unit of an air conditioner, the blade unit includes a blade coupled with a main body to be rotatable in the outlet, a motor including a rotation transfer member, and configured to generate a rotatory force that is transferred to the blade, and a buffer member made of a material having a restoring force, and coupled with the blade at one end, wherein a part of the rotation transfer member is inserted into and coupled with the buffer member.

The blade may include a coupling member in which a coupling groove is formed, at one edge, and the buffer member is inserted into the coupling groove.

The buffer member may include a buffer groove into which the rotation transfer member is inserted.

The rotation transfer member may include a rotation shaft extending from the motor, and configured to transfer a rotatory force generated by the motor, and a connection member coupled with the rotation shaft at one end, and coupled with the buffer member at the other end.

The connection member may include a connection body part coupled with the rotation shaft, and a connection protrusion extending from the connection body part, and coupled with the buffer member.

The connection member may be made of a material having stiffness that is lower than stiffness of the rotation shaft.

In accordance with another aspect of the present disclosure an indoor unit of an air conditioner includes a main body mounted on a ceiling, a bottom panel having an outlet at one part, and coupled with a lower part of the main body, and a blade unit configured to adjust a direction in which air discharged from the outlet is discharged, wherein the blade unit includes a blade coupled with the bottom panel to be rotatable in the outlet, a motor including a rotation transfer member, and configured to generate a rotatory force that is transferred to the blade, and a buffer member made of a material having a restoring force, and connected to the rotation transfer member and the blade such that the blade is maintained horizontally in the outlet even when the main body is installed non-horizontally.

The buffer member may include a buffer groove into which a part of the rotation transfer member is inserted.

The blade may include a coupling member in which a coupling groove is formed, at one edge, and the buffer member is inserted into the coupling groove.

The rotation transfer member may include a rotation shaft extending from the motor, and configured to transfer a rotatory force generated by the motor, and a connection member coupled with the rotation shaft at one end, and coupled with the buffer member at the other end.

The connection member may be made of a material having stiffness that is lower than stiffness of the rotation shaft.

Advantageous Effects

The indoor unit of the air conditioner according to a technical concept of the present invention, and the blade unit applied to the indoor unit can prevent vibrations and noise of the blade due to vibrations of the motor when the blade rotates.

Also, in the indoor unit of the ceiling type air conditioner according to a technical concept of the present invention, and the blade unit applied to the indoor unit, the blade can easily rotate in the outlet even when the indoor unit is installed non-horizontally to the ceiling.

BRIEF DESCRIPTION OF THE DRAWINGS

FIG. 1 is an exploded perspective view showing an indoor unit of an air conditioner according to an embodiment of the present invention, and a blade unit applied to the indoor unit.

FIG. 2 is a cross-sectional view schematically showing an indoor unit of an air conditioner according to an embodiment of the present invention.

FIG. 3 is an exploded perspective view showing the blade unit according to an embodiment of the present invention.

FIG. 4 is a cross-sectional view of the blade unit cut along a line A-A of FIG. 3.

FIG. 5 is a side view showing a blade in which a coupling member of FIG. 3 is formed.

FIG. 6 shows a buffer member in the blade unit of FIG. 3.

FIG. 7 shows a side of the butter member of FIG. 6 in which a buffer groove is formed.

FIG. 8 shows a connection member of the blade unit of FIG. 3.

FIG. 9 is a front view showing a side of the connection member of FIG. 8 in which a connection groove is formed.

FIG. 10 shows a third coupling member of the blade unit of FIG. 3.

FIG. 11 is an exploded perspective view showing a configuration of the third coupling member of FIG. 10.

FIG. 12 shows a blade unit according to another embodiment of the present invention.

FIG. 13 is an exploded perspective view showing a configuration of the blade unit of FIG. 12.

FIG. 14 is a cross-sectional view of the blade unit cut along a line B-B of FIG. 12.

FIG. 15 shows a modified example of the blade unit of FIG. 12.

FIG. 16 is an exploded perspective view showing a blade unit of FIG. 15.

FIG. 17 shows a blade unit according to another embodiment of the present invention.

BEST MODE

Hereinafter, preferred embodiments of the present invention will be described in detail.

Also, hereinafter, for convenience of description, an indoor unit of a ceiling type air conditioner will be described as an example. However, a blade unit according to an embodiment of the present invention can be applied to an indoor unit of another type air conditioner, such as an indoor unit of a stand type air conditioner and an indoor unit of a wall-mounted air conditioner.

FIG. 1 is an exploded perspective view showing an indoor unit of an air conditioner according to an embodiment of the present invention, and a blade unit applied to the indoor unit, and FIG. 2 is a cross-sectional view schematically showing an indoor unit of an air conditioner according to an embodiment of the present invention.

Referring to FIGS. 1 and 2, an indoor unit 1 of an air conditioner according to an embodiment of the present invention may include a main body configured to be hung on or embedded into a ceiling, and a bottom panel coupled with the lower part of the main body 10.

The main body 10 may be in the shape of a box, and may include a heat exchanger 12 configured to heat-exchange inhaled indoor air with refrigerants, a blower fan 11 configured to make air flow forcedly, and a control unit 17 configured to control operations of the indoor unit 1 of the air conditioner.

The main body 10 may include an upper plate 10*a* and side plates 10*b* forming the front, back, left, and right appearances of the air conditioner. The main body 10 may include a scroll part 15 configured to guide air heat-exchanged through the heat exchanger 12 towards an outlet 13.

In the lower part of the main body 10, an inlet 14 configured to inhale indoor air to the inside of the main body 10, and the outlet 13 configured to discharge heat-exchanged air to the indoor space may be provided. In the outlet 13, a wind-direction control member 19 may be provided to adjust the left-right direction of discharged air.

The heat exchanger 12 may include a tube 12*b* through which refrigerants flow, and a plurality of heat-exchange pins 12*b* contacting the tube 12*a* to widen a heat transfer area. The heat exchanger 12 may be inclined to be at nearly right angles to the direction of air flow.

Between the heat-exchanger 12 and the inlet 14, a guide rib 16 may be provided to guide indoor air inhaled into the inside of the main body 10 through the inlet 14 towards the heat exchanger 12. The guide rib 16 may be inclined to be at nearly right angles to the position of the heat exchanger 12.

Below the heat exchanger 12, a drain cover 18 may be provided to collect condensation water generated from the heat exchanger 12. Condensation water collected in the drain cover 18 may be drained to the outside through a drainage hose (not shown).

The blower fan 11 may be rotated by a driving force of a driving motor (not shown) to make air flow forcedly. A rotating shaft 11*a* of the blower fan 11 may be disposed to be nearly horizontal to the ground. The blower fan 11 may be a crossflow fan.

The bottom panel 20 may include a grill 30 disposed to correspond to the inlet 14 in order to prevent foreign materials from entering the inside of the main body 10, and a panel outlet 21 disposed to correspond to the outlet 13. In the panel outlet 21, a blade unit 100 may be rotatably disposed to open or close the panel outlet 21 or to adjust the up-down direction of discharged air. The panel outlet 21, which is formed at the bottom panel 20, may be connected to the outlet 13. Accordingly, in the following description, the outlet 13 and the panel outlet 21 will be collectively called an outlet 21.

The bottom panel 20 may include a filter member 24 configured to filter out foreign materials from air entered the inside of the main body 10 through the inlet 14.

If the filter member 24 is used for long periods of time to collect many foreign materials therein, the filter member 24 may be cleaned or replaced with new one. In this case, in order to easily detach the filter member 24, the grill 30 may be configured to be selectively opened with respect to the bottom panel 20.

The grill 30 may rotate to be opened or closed in the state in which it is fixed and supported on the bottom panel 20 at its rear part.

The grill 30 may be disposed in front of the filter member 24 of the bottom panel 20, and at least one part of the grill 30 may be cut to form a grill inlet 31.

Hereinafter, the blade unit 100 according to an embodiment of the present invention will be described in detail.

FIG. 3 is an exploded perspective view showing the blade unit 100 according to an embodiment of the present invention, FIG. 4 is a cross-sectional view of the blade unit 100 cut along a line A-A of FIG. 3, FIG. 5 is a side view showing a blade in which a coupling member of FIG. 3 is formed, FIG. 6 shows a buffer member in the blade unit 100 of FIG. 3, FIG. 7 shows a side of the butter member of FIG. 6 in which a buffer groove is formed, FIG. 8 shows a connection member of the blade unit 100 of FIG. 3, FIG. 9 is a front view showing a side of the connection member of FIG. 8 in which a connection groove is formed, FIG. 10 shows a third coupling member of the blade unit 100 of FIG. 3, and FIG. 11 is an exploded perspective view showing a configuration of the third coupling member of FIG. 10.

Referring to FIGS. 3 to 11, the blade unit 100 may include a blade 110. The blade unit 100 may be configured such that the blade 110 disposed in the outlet 21 rotates to adjust the direction of air heat-exchanged in and discharged from the inside of the main body 10.

The blade 110 may be coupled with one edge of the bottom panel 20 so as to be rotatable in the outlet 21, as shown in FIG. 1. More specifically, the blade 110 may be hinge-coupled with one edge of the bottom panel 20 to be rotatable. The blade 110 may have a shape corresponding to the outlet 21 in order to open or close the outlet 21. The blade 110 may be disposed in the inside of the outlet 21, and configured to rotate on the axis of its one edge hinge-coupled with the bottom panel 20.

According to an example, the blade 110 may include a body part 115, and coupling members 111 and 119.

The body part 115 may have a shape corresponding to the outlet 21. The body part 115 may be in the shape of a rectangular plate. The section of the body part 115 may be smaller than the section of the outlet 21 so that the body part 115 can be positioned in the inside of the outlet 21.

The coupling members 111 and 119 can be disposed on one edge of the body part 115. The coupling members 111 and 119 can couple the body part 115 with the main body 10 or the bottom panel 20 such that the body part 115 is rotatable.

The coupling members 111 and 119 can be provided as a plurality of coupling members. The plurality of coupling members 111 and 119 can be arranged in a straight line on one edge of the body part 115. Accordingly, the blade 110 can rotate on the axis of the straight line formed by the plurality of coupling members 111 and 119.

The plurality of coupling members 111 and 119 can be respectively disposed on both ends of the body part 115. The plurality of coupling members 111 and 119 can include a first coupling member 111 and a second coupling member (not shown), The first coupling member 111 may be, as shown in FIG. 3, connected to a motor 140 which will be described later. The second coupling member may be positioned to face the first coupling member 111 on the blade 110. The second coupling member may be connected to the main body 10 or the bottom panel 20 such that the blade 110 is rotatable.

As shown in FIG. 5, the first coupling member 111 may include a coupling groove 112 and a fixing hole 113.

The coupling groove 112 may be formed in one side of the first coupling member 111. The coupling groove 112 may be, as shown in FIG. 3, formed in the side of the first coupling member 111 facing the motor 140 which will be described later. A buffer member 120 which will be described later may be inserted into the coupling groove 112. The coupling groove 112 may have a shape corresponding to the shape of the buffer member 120 which will be described.

The fixing hole 113 may be formed in a surface of the coupling groove 112 which is face the opening of the coupling groove 112. A buffer protrusion 122 of the buffer member 120 which will be described later may be inserted into the fixing hole 113. If the buffer protrusion 122 is inserted into the fixing hole 113, the fixing hole 113 may fix the buffer member 120 at the first coupling member 111. However, the fixing hole 113 may be omitted.

The second coupling member may be positioned to face the first coupling member 111 on the blade 110. The second coupling member may be hinge-coupled with the main body 10 or the bottom panel 20 so that the blade 110 can rotate.

As shown in FIG. 3, the coupling members 111 and 119 may further include a third coupling member 119. The third coupling member 119 may be positioned between the first coupling member 111 and the second coupling member. The third coupling member 119 may be positioned on the straight line formed by the first coupling member 111 and the second coupling member. The third coupling member 119 may be hinge-coupled with the main body 10 or the bottom panel 20 so that the blade 110 can rotate. Also, a plurality of third coupling members 119 may be arranged at regular intervals between the first coupling member 111 and the second coupling member.

As shown in FIGS. 10 and 11, the third coupling member 119 may include an external frame 119*a*, a buffer part 119*b*, and a protrusion 119*c*.

The external frame 119*a* may form the outer side portion of the third coupling member 119. The buffer part 119*b* may be inserted into the inside of the external frame 119*a*. The buffer part 119*b* may be made of a material having a restoring force. Also, the butter part 119*b* may be made of a material having elasticity. One end of the protrusion 119*c* may be inserted into the buffer part 119*b*, and the other end of the protrusion 119*c* may extend from the buffer part 119*b*. The protrusion 119*c* may be coupled with the main body 10 or the bottom panel 20. According to the above-described configuration, the third coupling member 119 may enable the blade 110 to rotate in the outlet 21 by changing the shape of the buffer part 119*b*.

The blade unit 100 may further include the motor 140.

The motor 140 may be installed in the inside of the main body 10 to generate a rotatory force that is transferred to the blade 110. The motor 140 may include a rotation transfer member 150. The rotation transfer member 150 can transfer a rotatory force generated by the motor 140 to the blade 110. The configuration of the rotation transfer member 150 will be described later.

The blade unit 100 may further include the buffer member 120.

The buffer member 120 can be connected to the blade 110 and the rotation transfer member 150 of the motor 140. The buffer member 120 can be coupled with the blade 110 at one end, while surrounding a part of the rotation transfer member 150. The buffer member 120 can be inserted into one end of the blade 110, while surrounding a part of the rotation transfer member 150. The buffer member 120 can transfer a rotatory force to the blade 110, while rotating together with the rotation transfer member 150.

The buffer member 120 can be inserted into the coupling groove 112 of the first coupling part 111. The buffer member 120 can have a shape corresponding to the coupling groove 112. The buffer member 120 can be in the shape of a faceted pillar having at least one edge in the longitudinal direction. Accordingly, the buffer member 120 can rotate together with the first coupling member 111 in the state in which it is inserted into the coupling groove 112.

According to an example, the buffer member 120 can include a buffer body part 121, a buffer protrusion 122, and a buffer groove 123.

The buffer body part 121 may have a shape corresponding to the coupling groove 112. As shown in FIG. 4, the buffer body part 121 may be inserted into and rested in the inside of the coupling groove 112 of the first coupling member 111. The buffer body part 121 may include a stopping part 121*a* at one end. The stopping part 121*a* may extend from one end of the buffer body part 121, and be caught by the first coupling member 111 when the buffer body part 121 is completely inserted into the coupling groove 112. However, the stopping part 121*a* may be omitted.

The buffer protrusion 122 may be formed at one end of the buffer body part 121. The buffer protrusion 122 may be positioned to correspond to the fixing hole 113 when the buffer body part 121 is inserted into the coupling groove 112. The buffer protrusion 122 may extend from the buffer body part 121. The buffer protrusion 122 may be inserted into the fixing hole 113 of the first coupling member 111.

The buffer protrusion 122 may include a first protrusion 122*b* and a second protrusion 122*a*. The first protrusion 122*b* may extend from the buffer body part 121. The first protrusion 122*b* may connect the buffer body part 121 to the second protrusion 122*a*. The first protrusion 122*b* may be inserted into the fixing hole 113. The section of the first protrusion 122*b* may correspond to the inside section of the fixing hole 113.

The second protrusion 122*a* may be positioned at one end of the first protrusion 122*b*. The second protrusion 122*a* may have a shape tapering from its part connected to the first protrusion 122*b*. The second protrusion 122*a* may be in the shape of a cone. The section of one end of the second protrusion 122*a* may be larger than that of the fixing groove 113. One end of the second protrusion 122*a* may be caught by the outer edge of the fixing hole 113 when the buffer member 120 is completely inserted into the coupling groove 112.

The buffer groove 123 may be formed in a portion of the buffer body part 121. The buffer groove 123 may be formed in a portion of the buffer body part 121 that is opposite to the buffer protrusion 122. The rotation transfer member 150 which will be described later may be inserted into the buffer groove 123. The buffer groove 123 may have a shape corresponding to the rotation transfer member 150.

The buffer groove 123 may be in the shape of a pillar having at least one edge in the longitudinal direction. The buffer groove 123 may be in the shape of a pillar whose section is in the shape of "+". The buffer groove 123 may be in the shape of a faceted pillar having at least one edge at the side. The buffer groove 123 may rotate together with the rotation transfer member 150 inserted thereinto to receive a rotatory force.

The buffer member 120 may be made of a material having a restoring force. Also, the buffer member 120 may be made of a material having elasticity. Accordingly, even when the rotation transfer member 150 and the blade 110 are not aligned on a straight line, the shape of the buffer member 120 may change so as to locate the blade 110 at a predetermined position. Also, the buffer member 120 may prevent vibrations and noise from being generated by vibrations of the motor 140 and rotation of the blade 110. According to an example, the buffer member 120 may include rubber.

The rotation transfer member 150 can be connected to the motor 140 to transfer a rotatory force generated by the motor 140 to the blade 110. The rotation transfer member 150 can include a rotation shaft 151 and a connection member 152.

The rotation shaft 151 may extend from one part of the motor 140. The rotation shaft 151 may receive a rotatory force directly from the motor 140 and rotate.

The connection member 152 may be coupled with the rotation shaft 151 at one end, and coupled with the buffer member 120 at the other end. The connection member 152 may rotate together with the rotation shaft 151 to transfer a rotatory force to the buffer member 120 connected thereto.

As shown in FIG. 8, the connection member 152 may include a connection body part 152*a*, a connection protrusion 152*b*, and a connection groove 152*c*.

The connection body part 152*a* may be coupled with the rotation shaft 151 at one end. In the one end of the connection body part 152*a*, a connection groove 152*c* may be formed. The rotation shaft 151 may be inserted into the connection groove 152*c*. The connection groove 152*c* may be configured such that the connection member 152 can rotate together with the rotation shaft 151 in the state in which the rotation shaft 151 is inserted into the connection groove 152*c*. The connection groove 152*c* may have a shape corresponding to the rotation shaft 151.

The connection protrusion 152*b* may extend from the other end of the connection body part 152*a*. The connection protrusion 152*b* may be formed in a portion of the connection body part 152*a* that is opposite to the connection groove 152.

The connection protrusion 152*b* may be coupled with the buffer member 120. The connection protrusion 152*b* may be inserted into the buffer groove 123. The connection protrusion 152*b* may have a shape corresponding to the buffer groove 123. The connection protrusion 152*b* and the buffer groove 123 may be in the shape of a pillar whose section is in the shape of "+". The connection protrusion 152*b* and the buffer groove 123 may be in the shape of a faceted pillar having at least one edge at the side. The connection protrusion 152*b* may rotate together with the buffer member 120 in the state in which it is inserted into the buffer groove 123.

The connection member 152 may be made of a material having stiffness that is lower than that of the rotation shaft 151 of the motor 140. For example, the rotation shaft 151 of the motor 140 may be made of a metal material, and the connection member 152 may be made of a plastic material. Accordingly, the connection member 152 may prevent the buffer member 120 from being damaged upon rotation, compared to when the rotation shaft 151 made of a metal material is directly connected to the buffer member 120.

In general, if the main body 10 is installed non-horizontally, the rotation transfer member 150 and the blade 110 may be not aligned on a straight line. In this case, the rotation axis of the blade 110 may change to disable the blade 110 to rotate, or the blade 110 may make vibrations and noise upon rotation.

However, in the blade unit 100 according to the above-described embodiment of the present invention, the buffer member 120 may be provided between the motor 140 and the blade 110. The buffer member 120 may be made of a material having a restoring force to change its shape according to an external force. Accordingly, when the rotation transfer member 150 and the blade 110 are not aligned on a straight line, the shape of the buffer member 120 may change partially so as to locate the blade 110 at an appropriate position where it can rotate. Therefore, the blade 110 can be easily rotated, and also, vibrations and noise that can be generated due to rotation of the blade 110 can be prevented.

Hereinafter, a blade unit according to another embodiment of the present invention will be described.

FIG. 12 shows a blade unit according to another embodiment of the present invention, FIG. 13 is an exploded perspective view showing a configuration of the blade unit of FIG. 12, and FIG. 14 is a cross-sectional view of the blade unit cut along a line B-B of FIG. 12.

Referring to FIGS. 12, 13, and 14, a blade unit 200 may include a blade 210, a buffer member 220, a motor 240, a rotation transfer member 250, and a guide hole 271 to guide the rotation transfer member 250. Comparing to the blade unit 100 of FIG. 3, the blade unit 200 may further include the guide hole 271 to guide the rotation transfer member 250, and the remaining components of the blade unit 200 may be the same as those of the blade unit 100 of FIG. 3. Hereinafter, descriptions about the same components of the blade unit 200 as those of the blade unit 100 of FIG. 3 will be omitted, and the blade unit 200 will be described based on differences from the blade unit 100 of FIG. 3.

The guide hole 271 may be disposed in a partition wall 270 forming the outlet 21 in the inside of the bottom panel 20. The guide hole 271 may be formed on a straight line on which a first coupling member 211 of the blade 210 and the rotation transfer member 250 are aligned. The guide hole 271 may function as a passage through which the motor 240 is connected to the blade 210.

The guide hole 271 may guide the position of the rotation transfer member 250 connected to the motor 240 when the main body 10 or the bottom panel 20 is installed non-horizontally. The rotation transfer member 250 may be supported by the guide hole 271 when the main body 10 or the bottom panel 20 is maintained non-horizontally. Accordingly, the rotation transfer member 250 may be maintained at a predetermined position even when the main body 10 or the bottom panel 20 is installed non-horizontally. Also, since the rotation transfer member 250 is supported by the guide hole 271 when the main body 10 or the bottom panel 20 is installed non-horizontally, the guide hole 271 can reduce load transferred to the rotation transfer member 250. Accordingly, it is possible to prevent the blade unit 200 from being damaged, while improving the reliability of the blade unit 200.

Hereinafter, a modified example of the blade unit 200 will be described.

FIG. 15 shows a modified example of the blade unit 200 of FIG. 12, and FIG. 16 is an exploded perspective view showing a blade unit of FIG. 15.

Referring to FIGS. 15 and 16, a blade unit 201 may include the blade 210, the buffer member 220, the motor 240, the rotation transfer member 250, the guide hole 271, and a gear unit 280. Comparing to the blade unit 200 of FIG. 14, the blade unit 201 may further include the gear unit 280, and the remaining components of the blade unit 201 may be the same as those of the blade unit 200 of FIG. 14. Hereinafter, the blade unit 201 will be described based on differences from the blade unit 200 of FIG. 14.

The gear unit 280 may be configured to transfer greater torque to the blade 210 although the same motor 240 is used. According to an example, the gear unit 280 may include a first gear 281 and a second gear 282. The first gear 281 may connect a rotation shaft 281*a* to the motor 240. The second gear 282 may couple a rotation shaft 282*a* with the blade 210. The second gear 282 may have a greater diameter than the first gear 281.

The first gear 281 may be interlocked with the second gear 282. According to the above-described configuration, the second gear 282 can transfer greater torque to the blade 210 than the first gear 281. The gear unit 280 may generate great torque although the same motor is used, so as to reduce vibrations and noise that are generated upon use of the high capacity motor 240.

Hereinafter, a blade unit according to another embodiment of the present invention will be described.

FIG. 17 shows a blade unit according to another embodiment of the present invention.

Referring to FIG. 17, a blade unit 300 may include a blade 310, a buffer member 320, a motor 340, and a rotation transfer member 341. Comparing to the blade unit 100 of FIG. 3, the rotation transfer member 341 of the blade unit 300 is different from the corresponding one of the blade unit 100 of FIG. 3, and the remaining components of the blade unit 300 are the same as those of the blade unit 100 of FIG. 3. Hereinafter, the blade unit 300 will be described based on differences from the blade unit 100 of FIG. 3.

The rotation transfer member 341 may be provided as a rotation shaft extending from one end of the motor 340. Unlike the blade unit 100 of FIG. 3, in the blade unit 300, the rotation shaft 341 may be directly coupled with the buffer member 320. The rotation shaft 341 may be inserted into a buffer groove 323 formed in the buffer member 320. Accordingly, the rotation shaft 341 may rotate due to a rotatory force transferred from the motor 340 in the state in which it is inserted into the buffer groove 232, and transfer the rotatory force to the blade 310.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The invention claimed is:

1. An indoor unit of an air conditioner, comprising:
a main body including an outlet; and
a blade unit coupled with the main body to be rotatable at the outlet,
wherein the blade unit comprises:
a rectangular blade having longitudinal side edges and end edges and a coupling socket formed with the rectangular blade;
a motor including a rotation transfer shaft, and configured to generate a force driving the rectangular blade; and
a buffer sleeve coupled with the coupling socket of the rectangular blade, and covering a part of the rotation transfer shaft,
wherein the coupling socket includes a coupling groove disposed on a rotation axis of the rectangular blade and between the end edges of the rectangular blade,
wherein a part of the buffer sleeve is inserted into the coupling groove.

2. The indoor unit according to claim 1, wherein the coupling groove is formed on the rectangular blade in a manner to not protrude from the end edges of a rectangular body of the rectangular blade.

3. The indoor unit according to claim 1, wherein the coupling socket includes an inclined portion provided to be inclined with respect to a surface of the rectangular blade.

4. The indoor unit according to claim 1, wherein the coupling socket includes an upper outer portion provided to be inclined with respect to an upper surface of the rectangular blade.

5. The indoor unit according to claim 1, wherein the coupling groove of the coupling socket for receiving the part of the buffer sleeve is disposed at a position spaced apart from a center of one of the end edges of the rectangular blade.

6. The indoor unit according to claim 1, wherein:
an inside of the coupling groove is provided in a polygonal shape, and
the part of the buffer sleeve has a shape corresponding to the polygonal shape of the coupling groove to be inserted into the coupling groove.

7. The indoor unit according to claim 1, wherein the buffer sleeve is made of a material having a restoring force.

8. The indoor unit according to claim 1, wherein:
the coupling socket comprises:
a first coupling member connected to the rotation transfer shaft and disposed near a first of the end edges of the rectangular blade;
a second coupling member disposed near a second of the end edges of the rectangular blade to face the first coupling member, and connected to the main body such that the rectangular blade is rotatable; and
a third coupling member positioned between the first coupling member and the second coupling member, and
the third coupling member couples the rectangular blade with the main body such that the rectangular blade is rotatable.

9. The indoor unit according to claim 8, wherein the third coupling member comprises:
a protrusion coupled with a part of the main body; and
a buffer part made of a material having a restoring force, and surrounding the protrusion.

10. The indoor unit according to claim 1, wherein the coupling groove includes a fixing hole formed in a surface of the coupling groove in which at least some of the part of the buffer sleeve is inserted into the fixing hole in a manner that the part of the buffer sleeve is disposed on an inner side of the rectangular blade with respect to the coupling socket in a direction of the rotation axis of the rectangular blade.

11. The indoor unit according to claim 1, wherein:
the rotation transfer shaft comprises:
a rotation shaft extending from the motor, and configured to transfer a rotatory force generated by the motor; and
a connection member coupled with the rotation shaft at a first end, and coupled with the buffer sleeve at a second end, and the connection member comprising:
a connection body part coupled with the rotation shaft, and
a connection protrusion extending from the connection body part, and coupled with the buffer sleeve, and
the connection member is made of a material having stiffness that is lower than stiffness of the rotation shaft.

12. A blade unit coupled with a main body of an indoor unit of an air conditioner to be rotatable at an outlet provided in the indoor unit of the air conditioner, the blade unit comprising:
a rectangular blade having longitudinal side edges and end edges and a coupling socket formed with the rectangular blade;
a motor including a rotation transfer shaft, and configured to generate a force driving the rectangular blade; and
a buffer sleeve coupled with the coupling socket of the rectangular blade, and covering a part of the rotation transfer shaft,
wherein the coupling socket includes a coupling groove disposed on a rotation axis of the rectangular blade and between the end edges of the rectangular blade, and
wherein a part of the buffer sleeve member is inserted into the coupling groove.

13. The blade unit according to claim 12, wherein the coupling socket includes an inclined portion provided to be inclined with respect to a surface of the rectangular blade.

14. The blade unit according to claim 12, wherein the coupling socket is disposed at a position spaced apart from a center of a short edge of the rectangular blade.

15. The blade unit according to claim 12, wherein the coupling groove includes a fixing hole formed in a surface of the coupling groove in which at least some of the part of the buffer sleeve is inserted into the fixing hole in a manner that the part of the buffer sleeve is disposed on an inner side of the rectangular blade with respect to the coupling socket in a direction of the rotation axis of the rectangular blade.

16. The blade unit according to claim 12, wherein the part of the buffer sleeve and at least the part of the rotation transfer shaft overlap each other in a direction of the rotation axis of the rectangular blade inside the coupling groove.

17. The blade unit according to claim 12, wherein:

the rotation transfer shaft comprises:

a rotation shaft extending from the motor, and configured to transfer a rotatory force generated by the motor; and a connection member coupled with the rotation shaft at a first end, and coupled with the buffer sleeve at a second end, and the connection member comprising:

a connection body part coupled with the rotation shaft, and a connection protrusion extending from the connection body part, and coupled with the buffer sleeve, and the connection member is made of a material having a stiffness that is lower than a stiffness of the rotation shaft.

18. The blade unit according to claim 12, wherein the coupling groove is formed on the rectangular blade in a manner to not protrude from the end edges of a rectangular body of the rectangular blade.

19. The blade unit according to claim 12, wherein the coupling socket includes an upper outer portion provided to be inclined with respect to an upper surface of the rectangular blade.

20. The blade unit according to claim 12, wherein the coupling groove of the coupling socket for receiving the part of the buffer sleeve is disposed at a position spaced apart from a center of one of the end edges of the rectangular blade.

* * * * *